US007191807B2

(12) United States Patent
DeMaison et al.

(10) Patent No.: US 7,191,807 B2
(45) Date of Patent: Mar. 20, 2007

(54) APPARATUS FOR TONER PROCESSING INCLUDING A VARIABLE-ORIFICE NON-CONTACT VALVE

(75) Inventors: Dale A. DeMaison, Rochester, NY (US); Jeffery P. Kelsey, Geneva, NY (US); Thomas M. Bragg, Auburn, NY (US); Raymond G. Poole, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 204 days.

(21) Appl. No.: 11/011,672

(22) Filed: Dec. 14, 2004

(65) Prior Publication Data

US 2005/0220497 A1 Oct. 6, 2005

Related U.S. Application Data

(60) Provisional application No. 60/531,002, filed on Dec. 19, 2003.

(51) Int. Cl.
*B65B 1/04* (2006.01)

(52) U.S. Cl. ..... 141/83; 141/67; 141/302; 406/169; 406/91; 222/195; 222/504

(58) Field of Classification Search ..... 141/67, 141/69, 93, 285, 286, 301, 302, 83; 406/89–91, 406/169; 414/328, 397; 222/195, 564, 504
See application file for complete search history.

(56) References Cited

U.S. PATENT DOCUMENTS 4,659,263 A * 4/1987 Hanrot et al. ..... 406/89
6,227,768 B1 * 5/2001 Higuchi et al. ..... 406/89
6,609,871 B2 * 8/2003 Pfeiffer et al. ..... 414/328

* cited by examiner

*Primary Examiner*—Steven O. Douglas
(74) *Attorney, Agent, or Firm*—Lawrence P. Kessler

(57) ABSTRACT

An apparatus (10) for handling bulk particulate material (M) includes a reservoir hopper (16) having a gas-permeable liner (42) and a gas inlet (44) connecting the reservoir hopper (16) to a pressurized flow of gas sufficient to fluidize the material (M). A transition and pipe assembly (18) receives a flow of material (M) from the reservoir hopper (16). The transition and pipe assembly (18) has an outer conduit (54), an inner conduit (52), and at least one gas inlet (64). The outer conduit (54) is substantially impervious to gas whereas the inner conduit (52) is permeable to gas. The inner conduit (52) is disposed within and surrounded by the outer conduit (54). The gas inlet (64) connects the outer conduit (54) to a pressurized flow of gas to fluidize the material (M) within the inner conduit (52). A variable orifice non-contact valve (24) controls the flow of material (M) from the transition and pipe assembly (18).

24 Claims, 3 Drawing Sheets

APPARATUS FOR TONER PROCESSING INCLUDING A VARIABLE-ORIFICE NON-CONTACT VALVE

CROSS REFERENCE TO RELATED APPLICATION

Reference is made to and priority claimed from U.S. Provisional Application Ser. No. 60/531,002, filed Dec. 19, 2003, entitled APPARATUS FOR TONER PROCESSING INCLUDING A VARIABLE-ORIFICE NON-CONTACT VALVE.

FIELD OF THE INVENTION

The present invention relates to the handling and processing of fine powder materials. More particularly, the present invention relates to a method and apparatus for bottle filling and continuous feeding of such materials.

BACKGROUND OF THE INVENTION

The toner used in electrophotographic printing machines is a blend of materials or ingredients, including plastic resins, coloring pigments, magnetic iron oxides, waxes, charge control agents, and other ingredients. Most toners are produced in bulk using a melt mixing or hot compounding process. The materials are typically fed by continuous loss-in-weight auger-type feeders into an extruder where they are blended together while in a molten state to thereby form a hot paste having a consistency similar to cake mix. This mixture is then cooled, typically by forming it into slabs on a cooling belt or by pelletizing the mixture in water. The pellets are then ground or pulverized into a toner powder by jet mills or air-swept hammer mills. This process produces a powder having a range of particle sizes. The toner powder is sieved or sifted to remove over-size and under-size toner particles, and may be blended with additives to adjust flow and electrostatic charging properties. The finished bulk toner is then packaged into end-use containers, such as toner bottles or cartridges that are suitable for sale to and/or use by end users.

As discussed above, auger-type continuous loss-in-weight feeders are used to deliver the ingredients to the extruder. The auger-type feeders are often clustered together, and the multiple ingredients are fed into the extruder through a single extruder inlet. In such cases, side feeders/screw conveyors are often required since the relatively short auger-type feeders must be arranged in small feeder clusters, typically of two to four devices. The auger-type feeders typically require vibrators or agitators to promote the movement of the ingredients to the feeding auger. It can be difficult to achieve a consistent flow rate of such fine powdered ingredients through an auger-type feeder. Such powders may become fluidized, and flushing (uncontrolled flowing) of the fluidized powder through the feeder can occur. Therefore, the auger-type feeders generally require complicated control programs that are designed to adapt to the varying densities and flow characteristics of the powders as they move through the feeders.

After the toner powder is produced, it must be packaged. Packaging the toner or other powdered material into end-use containers generally involves the movement of the bulk toner from a filling hopper through a filling tube. The filling tube empties into toner bottles that have been conveyed into a toner bottle filling station. The toner is a fine powder that can have widely-varying bulk density and flow characteristics that may range from a dense cohesive powder to a low-density highly-fluid material. Conventional toner feeders/fillers typically involve moving the toner from one vessel to another by the force of gravity through vertically-oriented conduits that include an auger or a screw-feed system. Such auger-assisted, force-of-gravity systems are typically used to move the toner from the filler hopper through the filler tube and into the toner bottles. Since the toner tends to de-aerate or settle as it resides in a vessel or hopper, it can be difficult to obtain consistent gravimetric feed rates with auger-type feeders or fillers, which operate on a volumetric principle. On the other hand, highly-fluid toners may flush through an auger-type device and an uncontrolled flow or feed rate can result.

In short, the toner production process generally, and the bottle filling process in particular, has required that toner be fed from one vessel to the next utilizing either horizontal augers or auger-assisted force-of-gravity systems. Thus, for example, the bottle-filling hopper must typically be disposed above the bottle-filling station so that the force of gravity assisted by the auger moves the toner through the hopper, into and downward through the filler tube, and into the toner bottle. The need to feed toner from one vessel to the next by horizontal augers or by the force of gravity assisted by augers places substantial constraints on the process flow used to produce toner.

Further, the use of augers in the production of toner can have certain undesirable consequences. The augers must be precisely aligned, i.e., centered, relative to the funnel-shaped hopper outlet and extend through the outlet and into the filling tube and/or into the toner bottle. Even slight misalignment of the auger relative to the hopper outlet, filling tube, and/or toner bottle may bend the auger, causing the auger to seize. Augers may also bend during operation, installation, and during preventative maintenance. A bent or misaligned auger may rub against the funnel-shaped outlet, against the filler tube or against the toner bottle, causing toner to agglomerate or fuse on the auger. The agglomerated or fused toner may be dislodged and flake off from the auger into, and thereby contaminating, the packaged toner product. Bent or misaligned augers also require that the hopper and filling tube be emptied and cleaned. Seals used to seal the shafts of the augers become worn and fibers or lubricant from the worn seals may drop into and contaminate the finished toner product. Further, toner powder may penetrate through a worn seal, harden around the shaft, and then flake off into and contaminate the finished toner product, or may cause mechanical failure of bearings or other mechanical devices not intended to be exposed to toner.

The rotational speed or number of revolutions of an auger is often used as an indirect measure of the weight of toner dispensed into a toner bottle. However, toner powder de-aerates as it settles. On start up of the auger, toner particles in the hopper will be more densely packed and, therefore, more particles are carried by the auger. As the process continues and reaches a steady state, the toner particles are less densely packed and therefore fewer particles are carried by each revolution of the auger. Thus, the rotational speed or number of revolutions of the auger must be adjusted accordingly.

Therefore, what is needed in the art is an improved method and apparatus for conveying and/or feeding bulk toner through the toner production process.

Further, what is needed in the art is an improved method and apparatus for filling toner bottles.

Still further, what is needed in the art is a method and apparatus for conveying toner through the toner production process, which does not require the use of moving parts, such as augers, and rotating seals.

SUMMARY OF THE INVENTION

The present invention provides an apparatus for handling and conveying bulk particulate materials such as fine powders.

The invention provides, in one form thereof, a reservoir hopper having a gas-permeable liner and a gas inlet connecting the reservoir hopper to a pressurized flow of gas sufficient to fluidize the material. A transition and pipe assembly receives a flow of the material from the reservoir hopper. The transition and pipe assembly has an outer conduit, an inner conduit, and at least one gas inlet. The outer conduit is substantially impervious to gas whereas the inner conduit is permeable to gas. The inner conduit is disposed within and surrounded by the outer conduit. The gas inlet connects the outer conduit to a pressurized flow of gas to fluidize the material within the inner conduit. A variable orifice non-contact valve controls the flow of material from the transition and pipe assembly.

An advantage of the present invention is that the material is moved at least partially through the production and/or packaging process without the need for moving parts and/or augers.

A further advantage of the present invention is that the material can move in directions other than downward with the assistance of gravity.

A still further advantage of the present invention is compaction and/or flaking of toner due to contact with mechanical components is reduced.

Yet another advantage of the present invention is that the need for preventative maintenance is reduced.

An even further advantage of the present invention is that the flow of material can be in virtually any direction thereby allowing for a more manufacturing process flow.

Still further, another advantage of the present invention is that relatively accurate feed rates are obtained over substantial distances.

Even further, another advantage of the present invention is that feed rates can be controlled and varied over a wide range allowing for high bulk feed flow rates and low dribble feed flow rates for accuracy in container filling.

Lastly, an advantage of the present invention is that inert gas is used to provide an inert atmosphere thereby reducing the likelihood of explosion and/or product degradation.

Other advantages of the present invention include that it reduces potential for the generation of sparks and heat; controls the bulk density of the material so that operation of the unit and equipment downstream is more predictable; and provides two control variables (air flow and orifice size) to control feed rate whereas conventional auger-based systems provide only one control variable (i.e., rotational speed).

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplifications set out herein illustrate preferred embodiments of the invention, in one form, and such exemplifications are not to be construed as limiting the scope of the invention in any manner.

DETAILED DESCRIPTION OF THE DRAWINGS

Figure 1:
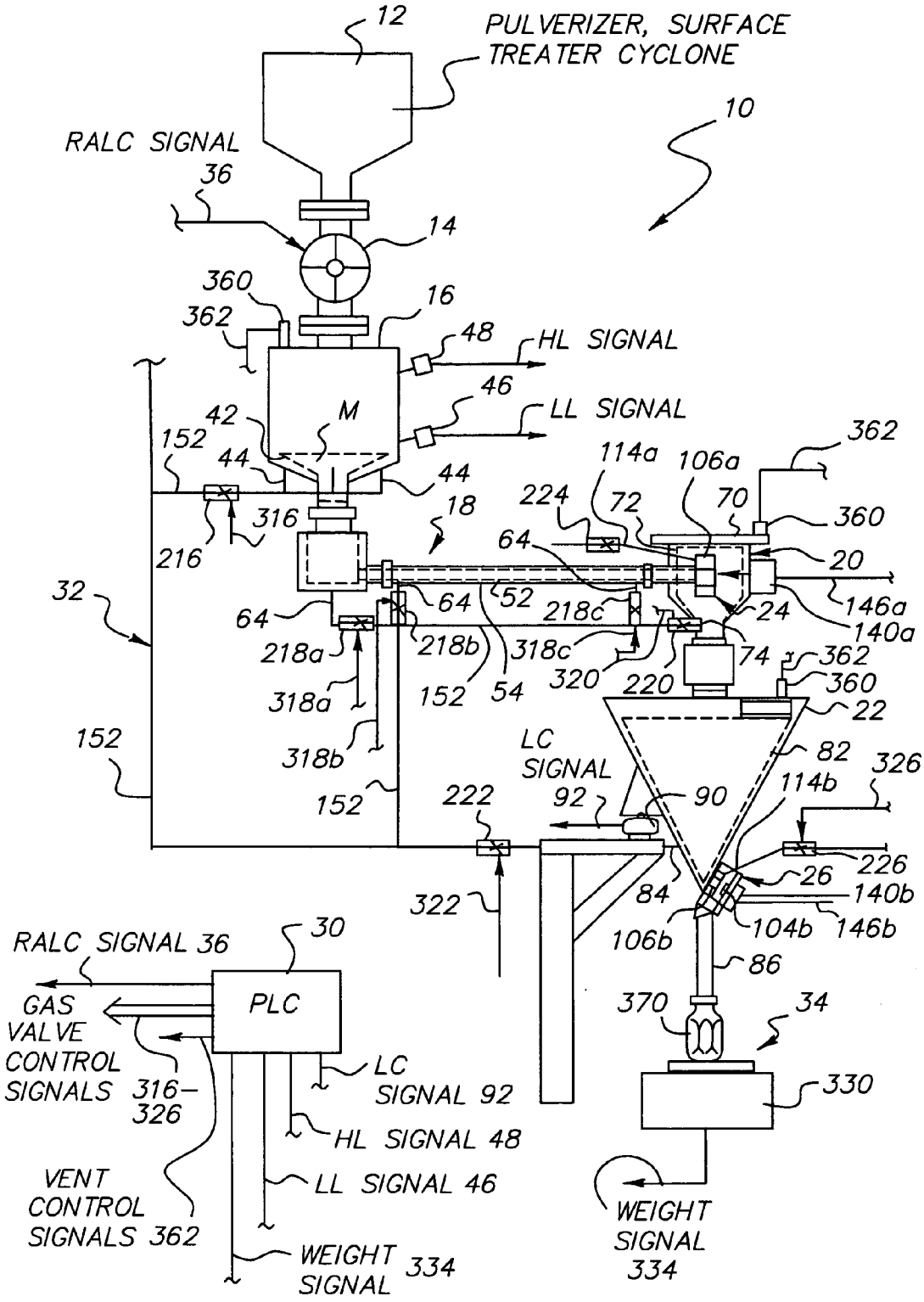
FIG. 1 is a diagrammatic view of one embodiment of a toner bottle filling apparatus of the present invention.

Referring now to FIG. 1, one embodiment of a toner bottle filling apparatus of the present invention is shown. Apparatus 10 includes a pulverizer or classifier receiver 12, rotary air lock valve 14, reservoir hopper 16, transition and pipe assembly 18, feeder hopper 20, discharge hopper 22, non-contact valves 24 and 26, programmable logic controller (PLC) 30, gas supply and control system 32, and fill station 34.

For convenience, apparatus 10 is discussed hereinafter in connection with toner for electrophotographic printing. However, it is to be understood that apparatus 10 is suitable for use with most fine powder materials, such as, for example, toner, carbon, silica, alumina, titanium dioxide, talc, plastic resins, pigments and other powdered materials that are classified in groups A, B and/or C of a Geldart Chart. Generally, apparatus 10 moves or conveys bulk toner or other fine powder through at least a portion of the production process and into containers, such as, for example, end-use toner bottles or other containers, and controls such movement without the need for augers and/or vibratory feeders.

Pulverizer or classifier receiver 12 (hereinafter referred to only as pulverizer 12) is a conventional pulverizer that reduces toner particles or particles of other powdered material M from a relatively large size to a smaller desired size or range of sizes. Pulverizer 12 is connected to reservoir hopper 16 via rotary air lock valve 14, through which material M passes out of pulverizer 12 and into reservoir hopper 16.

Rotary air lock valve 14 is a conventional rotary air lock that controls the flow of material M from pulverizer 12 and into reservoir hopper 16. Rotary air lock valve 14 is connected to PLC 30, which issues rotary air lock control (RALC) signal 36 to rotary air lock valve 14. RALC signal 36 determines, at least in part, the rate of rotation of rotary air lock valve 14 and thereby the rate of flow of material M into reservoir hopper 16.

Reservoir hopper 16 includes a liner 42 and gas inlets 44. Liner 42 is a gas-permeable liner that lines or covers at least a portion of the inner funnel-shaped wall of reservoir hopper 16. Liner 42 is therefore disposed between the covered portion of the inner walls of reservoir hopper 16 and material M contained therein. Gas inlets 44 are connected to gas supply and control system 32, which is more particularly described hereinafter. Gas supply and control system 32 via gas inlets 44 supplies a pressurized gas, such as, for example, air, nitrogen, or other inert gas, to the space between the inner walls of reservoir hopper 16 and liner 42. The gas permeates through liner 42 to fluidize the material M within at least the lined portion of reservoir hopper 16 to fluidize and thereby enhance the flow of material M through and out the funnel-shaped outlet of reservoir hopper 16. Reservoir hopper 16 further includes low and high level sensors 46 and 48, respectively, to sense the level of material M therein. Low and high-level sensors 46, 48, respectively, issue low and high-level signals LL signal and HL signal, respectively, to PLC 30. An outlet (not referenced) of reservoir 16 is connected to transition and pipe assembly 18, and material M passes from reservoir 16 through the outlet thereof and into transition and pipe assembly 18.

Transition and pipe assembly 18 is, in general, an elongate, fluidizing conduit that interconnects reservoir 16 with feeder hopper 20. One embodiment of a transition and pipe assembly 18 is fully described and completely disclosed in U.S. Pat. No. 6,609,871, entitled SYSTEM FOR HANDLING BULK PARTICULATE MATERIALS, the disclosure of which is incorporated herein by reference. Therefore, the details of the construction and operation of transition and pipe assembly 18 are not reproduced at length herein.

In general, however, transition and pipe assembly 18 includes an inner gas-permeable conduit 52 surrounded by an outer gas-impervious conduit 54. Transition and pipe assembly 18 further includes a plurality of gas inlets 64 along the length thereof, which are connected to gas supply and control system 32. Inlets 64 connect a plurality of chambers (not shown) defined between inner gas-permeable conduit 52 and outer gas-impervious conduit 54 with gas supply and control system 32. The gas permeates through inner gas-permeable conduit 52 to fluidize the material M within transition and pipe assembly 18 and thereby enhance the flow of material M through and out the funnel-shaped outlet of reservoir hopper 16. The pressure of gas supplied to each of the chambers in transition and pipe assembly 18 is controlled and can be varied and/or modulated along the length of transition and pipe assembly 18 to control the flow of material M therein. The outlet end (not referenced) of transition and pipe assembly 18 is connected via variable-orifice non-contact valve 24 to feeder hopper 20, and material M flows from transition and pipe assembly 18 through variable-orifice non-contact valve 24 and into feeder hopper 20.

Feeder hopper 20 includes sidewalls (not referenced), a top 70, and a gas-permeable liner 72. The sidewalls and top 70 of feeder hopper 20 are impervious to gas. Gas-permeable liner 72 is shaped generally like an inverted bag, and lines the sidewalls and top 70 of feeder hopper 20. Feeder hopper 20 receives material M from transition and pipe assembly 18 via variable-orifice non-contact valve 24, which is coupled to the outlet of transition and pipe assembly 18. The flow-controlling parts or components of non-contact valve 24 are disposed within and sealingly surrounded by gas-permeable liner 72, which also sealingly engages and surrounds the outlet end of transition and pipe assembly 18. Thus, the flow of material M from transition and pipe assembly 18 and out non-contact valve 24 is sealed within gas-permeable liner 72. Feeder hopper 20 includes gas inlet 74, which is supplied via gas supply and control system 32 with pressurized gas that fills the space between gas-permeable liner 72 and gas-impervious top 70 and sidewalls of feeder hopper 20. The gas permeates through gas-permeable liner 72 to fluidize the material M therein and to thereby enhance the flow of material M through and out the funnel-shaped outlet of feeder hopper 20 and into discharge hopper 22.

Discharge hopper 22 is a funnel-shaped hopper having a sidewall and a top that are impervious to gas, is lined with gas-permeable liner 82, and includes one or more gas inlets 84. Gas-permeable liner 82 lines the inside of discharge hopper 22. Discharge hopper 22 receives material M from feeder hopper 20 and dispenses material M to filling tube 86 via second non-contact valve 26. More particularly, material M flows from feeder hopper 20 into gas-permeable liner 82 of discharge hopper 22. Gas inlets 84 are supplied via gas supply and control system 32 with pressurized gas that fills the space between gas-permeable liner 82 and the gas-impervious walls and top of discharge hopper 22. The gas permeates through gas-permeable liner 82 to fluidize the material M therein. Second non-contact valve 26, which is described more particularly hereinafter, controls the flow of material M from within gas-permeable liner 82 and into filling tube 86. Material M flows through filling tube 86 and into a toner bottle 370 or other container disposed in an otherwise conventional bottle filling station 34.

One or more load cells 90 (only one shown) are operably associated with discharge hopper 22 to measure the weight of material M contained within discharge hopper 22. Load cells 90 are electrically connected to PLC 30, and issue thereto load cell signal (LC signal) 92 that is indicative of the weight and thus the amount of material M within discharge hopper 22.

Non-contact valves 24 and 26 are substantially similar in structure, and therefore a detailed discussion of non-contact valve 26 follows hereafter. It is to be understood that the following detailed discussion of non-contact valve 26 is also generally applicable to variable-orifice non-contact valve 24, and that any significant exceptions thereto are particularly discussed hereinafter.

Figure 3:
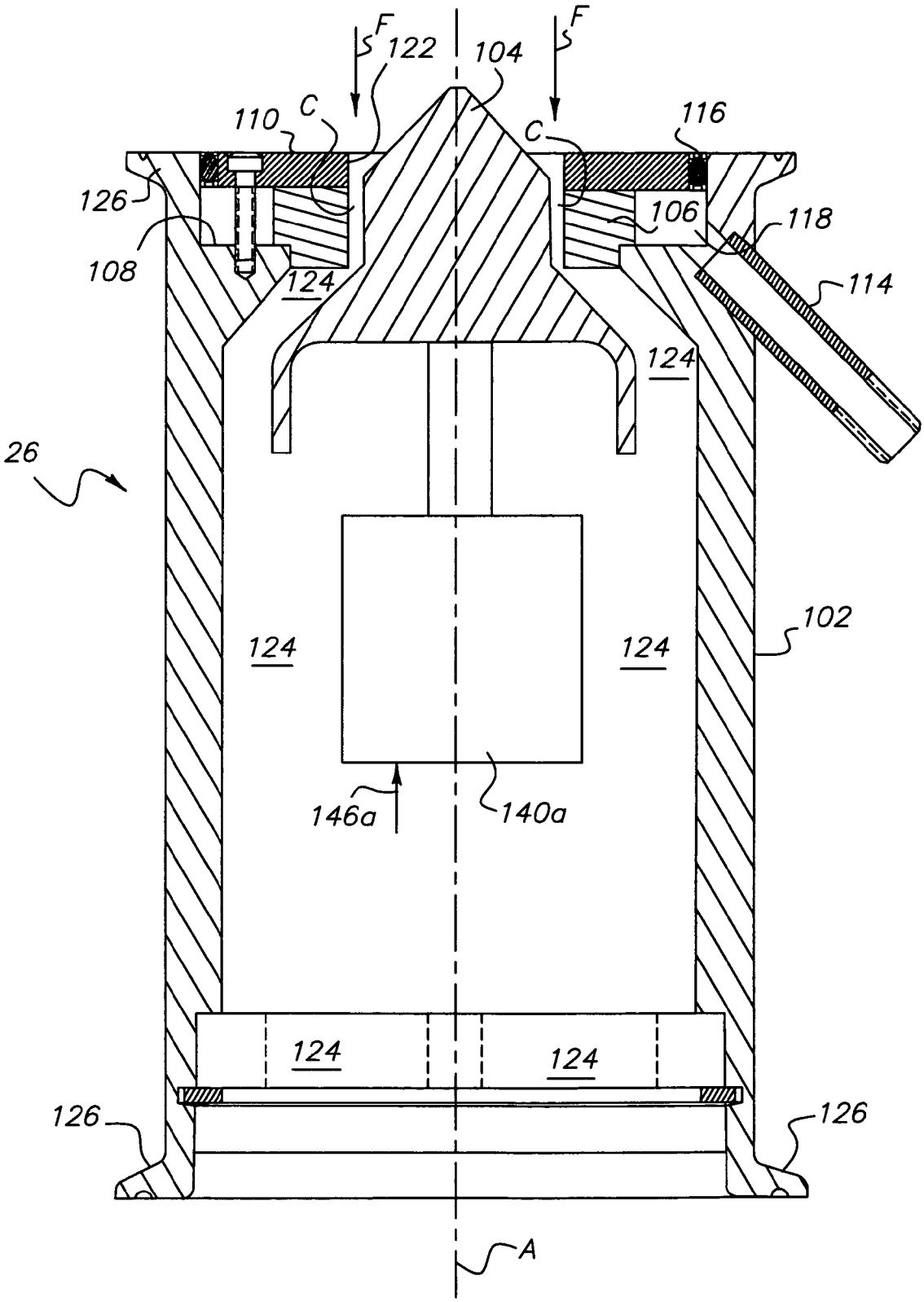
FIG. 3 is cross-sectional view of one embodiment of the non-contact valve of FIGS. 1 and 2.

As best shown in FIG. 3, non-contact valve 26 includes outer body 102, plug 104, and gas-porous ring 106. Generally, non-contact valve 26 adjusts the position of plug 104 relative to gas-porous ring 106 thereby adjusting the length of the flow path and/or size of the orifice through which material M flows. A curtain of high-velocity air/gas is thus created that controls the amount of material M flowing through non-contact valve 26. Valves 24 and 26 are in general, and plug 104, ring 106 and/or inlet orifice 122 in particular, configured to direct the flow of pressurized air or gas in a direction that opposes the flow of material M. Because non-contact valves 24 and 26 control the flow of material M by a "curtain of air" effect rather than by two surfaces that come into engagement and/or direct contact, the occurrence of clumping and flaking of material M is reduced.

Body 102 is a hollow cylindrical or tubular member having a central axis A and including an integral flange 108, front plate member 110, gas inlet 114 and sealing member 116. Flange 108 is formed around the inner periphery of body 102 proximate the inlet end of non-contact valve 26. Gas-porous ring 106 is seated upon flange 108. Plate member 110 is affixed, such as, for example, by bolts, screws or other fasteners, to body 102 and/or flange 108, to thereby capture gas-porous ring 106 between plate member 110 and flange 108. Sealing member 116 seals the interface of front plate member 110 and body 102. An annular chamber 118 is thus defined between flange 108, the inner wall of body 102 above flange 108, gas-porous ring 106, top plate 110, and sealing member 116. Gas inlet 114 is sealingly coupled to or integral with body 102, and extends from the outside of body 102 into chamber 118. Gas inlet 114 is connected at a first/outside end thereof to gas supply and control system 32 to thereby connect chamber 118 to a source of pressurized gas.

Central orifices (not referenced) defined by plate member 110 and gas-porous ring 106 have substantially equal diameters and are substantially coaxial relative to each other and relative to central axis A, and thereby form a substantially cylindrical inlet orifice 122. Inlet orifice 122 defines in part an inlet portion of flow path 124. The inlet portion of flow path 124 further includes flow channel C, which is defined by the region or clearance between the axial-overlapping portions of plug 104 and inlet orifice 122. Flow path 124 extends axially through body 102 from inlet orifice 122, through channel C, and through body 102 to the outlet end thereof. At each end body 102 defines mounting flanges 126 to enable non-contact valve 26 to be operably coupled and/or affixed to other pieces of equipment. Body 102 is constructed of a gas-impervious material, such as, for example, stainless steel, aluminum, brass, plastic, or other suitable gas-impervious materials.

Plug 104 is generally conical or frustoconical in shape, and is tapered from narrow to wide in the direction of flow F of material M. Plug 104 is substantially concentric relative to gas-porous ring 106, and is movable in an axial direction toward and away from inlet orifice 122. Plug 104 is dimensioned such that there is a predetermined minimum clearance, such as, for example, from approximately 0.005 to approximately 0.025 inches, between inlet orifice 122 and the largest-diameter portion of plug 104 that will be disposed within inlet orifice 122. Plug 104 is constructed of a gas-impervious material, such as, for example, stainless steel, aluminum, brass, plastic, or other suitable gas-impervious materials.

Gas-porous ring 106 is a ring of sintered material, such as, for example, stainless steel, brass, aluminum, or other suitable gas-permeable material. As discussed above, gas-porous ring 106 is captured between plate member 110 and flange 108 to thereby preclude or substantially limit movement of gas-porous ring 106 in the axial direction. Gas-porous ring 106 includes a grove or notch (not referenced) on the outer-diameter of its inner face that engages the lip (not referenced) of flange 108 to thereby preclude or substantially limit movement of gas-porous ring 106 in a radial direction. The pores of the surfaces of gas-porous ring 106 that are perpendicular to the direction of flow F of material M are closed or sealed, such as, for example, by machining and/or grinding. Therefore, gas-porous ring is porous only in the radial direction, i.e. the direction perpendicular to the direction of flow F, and gas flows from chamber 118 through gas-porous ring 106 in a direction toward and into inlet orifice 122 and through channel C.

It should be noted that in referring to the component parts of non-contact valve 24 the suffix letter "a" may be used, whereas the component parts of non-contact valve 26 may be referred to and/or be labeled with the suffix letter "b". Thus, for example, the gas-porous ring of non-contact valve 24 is referred to as and labeled with reference number 106*a*, whereas the gas-porous ring of non-contact valve 26 is referred to as and labeled with the reference number 106*b*. The suffixes are generally omitted from the description of the valves, except where clarity requires otherwise.

It should the also be noted that the body of non-contact valve 24, due to its generally horizontal orientation, is preferably constructed at least in part of a relatively wide mesh material to thereby permit material M to flow or drop into feeder hopper 20. Alternatively, the sidewalls and top of feeder hopper 20 form, at least in part, the body of non-contact valve 24.

Figure 2:
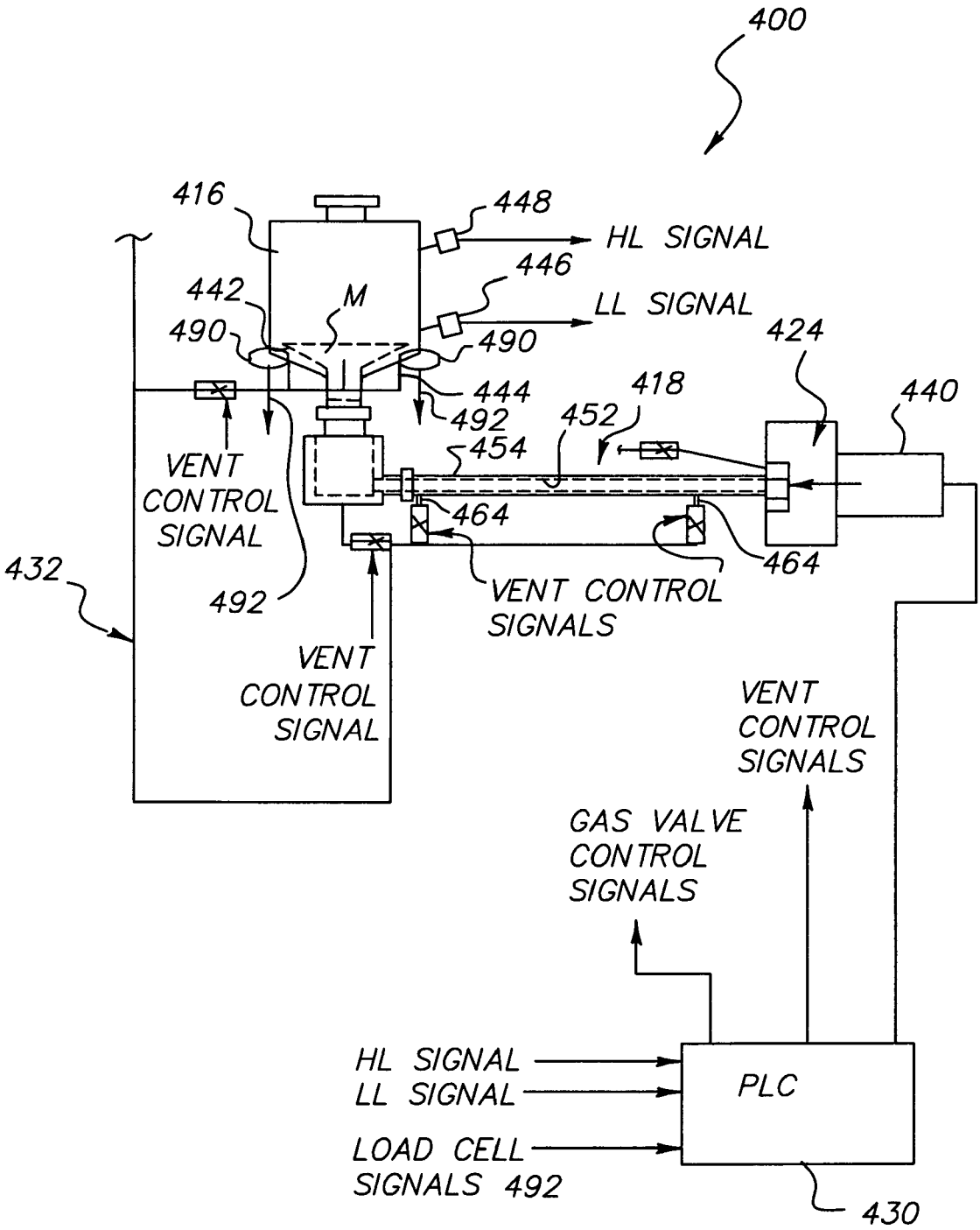
FIG. 2 is a diagrammatic view one embodiment of a toner feeding or conveying apparatus of the present invention.

Non-contact valves 24 and 26 are actuated by respective actuators 140*a*, 140*b*, such as, for example, air cylinders, linear motors, stepper motors, and/or other suitable actuators. Actuators 140*a*, 140*b* translate the corresponding plugs 104*a*, 104*b* in a direction toward and/or away from inlet orifices 122*a* and 122*b*, respectively. Actuators 140*a* and 140*b* are electrically connected to PLC 30, and receive therefrom actuator control signals 146*a* and 146*b*, respectively, that determine at least in part the position of plugs 104*a* and 104*b* relative to inlet orifices 122*a* and 122*b*, respectively. In the embodiment shown in FIG. 1, and as is more particularly described hereinafter, actuator 140*a* is disposed external to body 102*a* and is configured as a three-position actuator whereas actuator 140*b*, which is also disposed external to body 102*b*, is configured as a two-position actuator. As shown in FIG. 2, actuator 140*a*, and thus actuator 140*b*, can be exposed within the body of the corresponding non-contact valve. In such an embodiment, the actuator must be able to withstand the application operating conditions and be appropriately sealed against penetration of material M.

Programmable logic control (PLC) 30 is a conventional programmable logic controller. PLC 30 receives LL Signal and HL signal from low and high-level sensors 46 and 48, respectively, and receives weight signal 334 from scale 330. Further, or alternatively, PLC 30 receives LC Signal 92 from scale load cell 90. PLC 30 issues RALC signal 36 to rotary valve 14, issues gas valve control signals 316–326 to gas control valves 216–226, respectively, and issues vent control signals 362 to vents 360.

Gas supply and control system 32 includes a network of interconnected conduits 152 that interconnect each of gas inlets 44, 64, 74, 84, 114*a*, and 114*b* to a supply of pressurized gas (not shown), such as, for example, air, nitrogen, or other inert gas. Generally, a plurality of gas flow control valves control the flow of pressurized gas through, and the pressure within corresponding branches of, conduit 32 thereby controlling the pressure of the gas supplied via gas inlets 44, 64, 74, 84, 114*a*, and 114*b* to the corresponding component parts of apparatus 10.

More particularly, gas flow control valve 216 controls the flow of gas through inlet 44 and into reservoir hopper 16, and supplies that gas at a predetermined pressure/flow which is sufficient to fluidize material M therein, at least in the proximity of the funnel-shaped outlet thereof. Gas flow control valves 218*a*, 218*b*, and 218*c* control the flow of gas through inlets 64 and into respective chambers (not shown) along the length of transition and pipe assembly 18, and supplies that gas at a predetermined pressure/flow which is sufficient to fluidize material M therein. The pressure of gas supplied via gas flow control valves 218*a*, 218*b* and 218*c* is modulated, as discussed above, to control the flow of material M through transition and pipe assembly 18. Similarly, gas flow control valve 220 controls the flow of gas through inlet 74 and into feeder hopper 20, and supplies that gas at a predetermined pressure which is sufficient to fluidize material M therein. Gas flow control valve 222 controls the flow of gas through inlet 84 and into discharge hopper 22, and supplies that gas at a predetermined pressure sufficient to fluidize material M therein. Gas flow control valves 224 and 226 control the flow of gas to inlets 114*a* and 114*b*, and thereby control the flow of gas to non-contact valves 24 and 26, respectively.

Generally, the gas supplied to reservoir hopper 16, transition and pipe assembly 18, feeder hopper 20, and discharge hopper 22 by gas supply and control system 32 is supplied at a pressure sufficient to fluidize material M. For applications in which material M is toner or substantially similar to toner, the pressure is from, for example, approximately 0.5 to approximately 3.5 inches of water column. The pressure of gas supplied by gas supply and control system 32 to non-contact valves 24 and 26 for applications in which material M is toner or substantially similar to toner is from, for example, approximately 5 to approximately 10 pounds per square inch (psi). However, it is to be understood that the pressures required to fluidize material M and to operate non-contact valves 24 and 26 will vary depending at least in part upon the material properties of the particular material M being processed by apparatus 10. Further, it should be particularly noted that the pressure of gas required to operate non-contact valves 24 and 26 will depend at least in part upon the density of gas-porous rings 106*a* and 106*b*, respectively.

Each of gas flow control valves 216, 218*a*, 218*b*, 218*c*, 220, 222, 224, and 226 are electrically interconnected with PLC 30, and receive therefrom, respective gas valve control signals 316, 318*a*, 318B, 318*c*, 320, 322, 324, and 326. Gas control valves 216, 218*a*, 218*b*, 218*c*, 220, 222, 224, and 226 control the flow of gas dependent at least in part upon gas valve control signals 316, 318*a*, 318B, 318*c*, 320, 322, 324, and 326, respectively.

Fill station 34 is disposed at the outlet of filling tube 86, and includes a scale 330. Scale 330 is electrically connected with and issues weight signal 334 to PLC 30. Weight signal 334 is indicative of the amount of toner within bottle 370 sitting and/or disposed on scale 330. Fill station 34 is configured to raise and lower bottle 370 into and out of association with fill tube 86, and to reduce and/or minimize the amount of material M escaping to the environment.

In use, apparatus 10 fluidizes material M throughout the bottle filling process, thereby eliminating the need for augers and the problems associated therewith. Material M is moved and/or admitted into reservoir hopper 16 via rotary air lock 14. PLC 30 receives LL signal and HL signal from low and high-level sensors 46 and 48, respectively, and issues to rotary air lock 14 RALC signal 36 to control the rotational speed of rotary air lock 14 and to thereby maintain the level of material M within reservoir hopper 16 between predetermined low and high process levels.

The pressurized gas provided to reservoir hopper 16 by gas supply and control system 32 via gas inlet 44 fluidizes material M, which flows through the funnel-shaped outlet of reservoir hopper 16 and into transition and pipe assembly 18. Transition and pipe assembly 18 maintains material M in the fluidized condition or state, and modulates the pressure of the pressurized gas provided to the plurality of chambers distributed along the length thereof to thereby control the flow of material M as is more particularly described in U.S. Pat. No. 6,609,871 which, as stated above, is incorporated herein by reference. Material M must pass through non-contact valve 24 in order to enter feeder hopper 20.

The flow of material M through non-contact valve 24 is controlled by actuator 140*a* adjusting the position of plug 104*a* relative to inlet orifice 122*a* in response to and/or dependent at least in part upon actuator control signal 146*a* issued by PLC 30. More particularly, as plug 104*a* is moved upstream, i.e., against the direction of flow F of material M, nearer to and into inlet orifice 122*a* the axial positions of plug 104*a* and gas-porous ring 106*a* begin to overlap. Channel C is formed between adjacent and/or axially-overlapping portions of plug 104*a* and inlet orifice 122*a*.

The axial position of plug 104 is adjusted relative to inlet orifice 122 to thereby adjust the amount by which the two overlap and, in turn, adjust the length of channel C. As the length of channel C increases, the area of the corresponding portion of flow path 124 is reduced. Thus, the substantially constant or fixed flow of pressurized gas through gas-porous ring 106 must flow at a substantially increased rate or velocity through the restricted/reduced portion of flow path 124, i.e., the increased-length channel C. The increased velocity of the flow of gas through channel C creates a "curtain of air" effect therein that resists and/or prevents the flow of fluidized material M through channel C, dependent upon the length of channel C and the pressure at which material M is flowing. Valves 24 and 26 are in general, and plug 104 ring 106 and/or inlet orifice 122 in particular, are configured to direct the flow of pressurized air or gas in a direction that opposes the flow of material M.

Conversely, as plug 104 is moved downstream, i.e., in the direction of flow F of material M and away from inlet orifice 122, the axial overlap of plug 104 and gas-porous ring 106 is reduced and/or eliminated entirely. Thus, channel C is thereby reduced in length and/or eliminated entirely. As the length of channel C decreases, the substantially constant or fixed flow of pressurized gas into gas-porous ring 106 is less restricted and therefore flows at a reduced rate or velocity through the relatively less-restricted flow path 124, i.e., shortened -length channel C. The reduced velocity of the flow of gas through channel C reduces and/or removes the "curtain of air" effect therein and enables more fluidized material M to flow through channel C and flow path 124.

Material M flows out non-contact valve 24 and into feeder hopper 20. The pressurized gas supplied to feeder hopper 20 by gas supply and control system 32 via gas inlet 74 maintains material M in its fluidized state. Material M flows through the funnel-shaped outlet of feeder hopper 20 and into discharge hopper 22. Similarly, the pressurized gas supplied to discharge hopper 22 by gas supply and control system 32 via gas inlet 84 maintains material M in its fluidized state within discharge hopper 22. Material M must flow through non-contact valve 26 to enter filling tube 86.

Non-contact valve 26 operates in a manner that is similar to non-contact valve 24, i.e., actuator 140*b* adjusts the position of plug 104*b* in response to and/or dependent at least in part upon actuator control signal 146*b* to adjust the amount of overlap between plug 104*b* and inlet orifice 122*b* and thereby increase and/or decrease the length of channel C. Thus, the "curtain of air" effect is created and/or adjusted to thereby control the flow of fluidized material M through non-contact valve 26 and into filling tube 86 and ultimately into a toner bottle (not shown).

The flow of material M through apparatus 10 is controlled, at least in part, by reducing the flow of gas through gas inlets 44, 64, 74, and 84. The flow of material M is also controlled at least in part by vents 360, which are distributed throughout apparatus 10. More particularly, each of reservoir hopper 14, feeder hopper 20, and discharge hopper 22 are vented via respective vents 360, each of which are electrically connected to and receive respective vent control signals 362 from PLC 30. Each of vents 360 are opened and/or closed in response to corresponding vent control signals 362. Vents 360 are each connected to one or more recycling devices that filter particles of material M from the gas flowing therein and recycle the gas.

Toner bottle 370 is conveyed into fill station 34, and onto scale 330. Non-contact valve 26 is opened by PCL issuing an appropriate actuator control signal 146*b* to actuator 140*b*, and fluidized material M flows from discharge corresponding hopper 22 through filling tube 86 and into bottle 370. When the weight of toner bottle 370 is approaching the target, i.e., within a predetermined value of the desired weight, as indicated by scale 330 via weight signal 334, PLC 30 reduces the pressure of gas supplied by gas supply and control system 32 to one or more of reservoir hopper 16, transition and pipe assembly 18, feeder hopper 20 and/or discharge hopper 22 by issuing corresponding gas flow control signals 316, 318*a*, 318*b*, 318*c*, 320, and 322 to gas control valves 216, 218*a*, 218*b*, 218*c*, 220, and 222, respectively. Preferably, the fluidizing gas pressure within at least discharge hopper 22 is reduced. The reduced gas pressure slows the flow of material M and thereby enables more accurate filling or "topping off" of bottle 370. When the desired weight of bottle 370 is reached, as indicated at least in part by weight signal 334, non-contact valve 26 is closed by PLC 30 issuing to actuator 140*b* a corresponding actuator control signal 146*b*, and vents 360 are opened by appropriate vent control signals 362 to relieve the pressure within apparatus 10 and thereby stopping the flow of material M.

Alternatively, or additionally, PLC 30 receives LC Signal 92 from scale load cell 90, and controls the flow of material M based at least in part thereon to thereby control the filling of toner bottles.

Referring now to FIG. 2, a second embodiment of a toner feeder apparatus of the present invention is shown. Apparatus 400 includes reservoir hopper 416, transition and pipe assembly 418, non-contact valve 424, programmable logic controller (PLC) 430, and gas supply and control system 432. Apparatus 400 is similar to apparatus 10, except that variable-orifice non-contact valve 424 has a substantially-continuously variable actuator 440, such as, for example, a linear or stepper motor. Non-contact valve 424, rather than being disposed in a feeder hopper as in apparatus 10, is configured for being disposed in and/or coupled to virtually any gas impermeable but fluidizing housing which, in turn, is coupled to other processing stations and/or equipment for processing material M.

Apparatus 400 also includes load cells 490 which are associated with reservoir hopper 416, and which provide load cell signals 492 to PLC 430 to thereby enable PLC 430 to monitor the amount of toner within and/or that has flowed out of reservoir hopper 416.

Apparatus 400, rather than being a dedicated bottle filling apparatus, forms a portion of virtually any toner or fine-powder material feeding and/or conveying apparatus. By controlling the air pressure throughout apparatus 400, and particularly the air pressure supplied to reservoir hopper 416, transition and pipe assembly 418, and non-contact valve 424, the flow of material through apparatus 400 can be in virtually any direction, accurate feed rates are obtained over substantial distances, and the feed rate is controlled and varied over a wide range allowing for high bulk feed flow rates and low dribble feed flow rates. Further, by controlling the air pressure supplied to apparatus 400, the bulk density of the material is controlled thereby making operation of downstream equipment more predictable.

In the embodiment shown in FIG. 1, actuator 140*a* of variable-orifice non-contact valve 24 is configured as a three-position actuator having a first or bulk-fill position wherein plug 104*a* is substantially completely removed from inlet orifice 122*a*, a second or slow-fill position wherein a predetermined portion of plug 104*a* is disposed within inlet orifice 122, and a third stop-fill position wherein a substantial predetermined portion of plug 104*a* is disposed within inlet orifice 122. Similarly, in the embodiment shown in FIG. 1, actuator 140*b* of non-contact valve 26 is configured as a two-position actuator having a first or bulk-fill position wherein plug 104*b* is substantially completely removed from inlet orifice 122*b* and a second or stop-fill position wherein a substantial predetermined portion of plug 104*a* is disposed within inlet orifice 122. However, it is to be understood that either of actuators 140*a*, 140*b* can be alternately configured, such as, for example, as being continuously variable actuators that are capable of continuously varying the position of a respective plug relative to a corresponding inlet orifice.

In the embodiment shown in FIG. 1, the flow of material M through non-contact valves 24 and 26 is controlled by the axial position of plugs 104*a*, 104*b* relative to corresponding inlet orifices 122*a*, 122*b*. Gas supply and control system 32 supplies gas to gas-porous rings 106*a* and 106*b* of non-contact valves 24 and 26, respectively, at a predetermined and substantially constant pressure established and controlled via flow control valves 224 and 226. Thus, gas flow control valves 224 and 226 are maintained in a predetermined position, such as, for example, wide open. However, it is to be understood that the present invention can be alternately configured, such as, for example, to control the flow of material M through non-contact valves 24 and 26 by adjusting gas flow control valves 224 and 226 in response to and dependent at least in part upon corresponding gas valve control signals 324 and 326 to thereby adjust the flow of gas to gas-porous rings 106*a* and 106*b*.

In the embodiment shown, non-contact valves are configured with respective gas porous rings. However, it is to be understood that the non-contact valves of the present invention can be alternately configured with variously-shaped gas porous elements or members, such as, for example, rectangular gas-porous members and correspondingly shaped/configured plugs.

In the embodiment shown, non-contact valves 24 and 26 are described as non-contact valves configured for use with toner or other particulate material wherein contact of the valve plunger with the valve orifice would be likely to cause clumping or other undesirable affects in the particulate material. However, when used with particulate material not susceptible to the above-described undesirable affects due to contact, it is to be understood that non-contact valves 24 and 26 can be alternately configured and/or operated as contact valves, i.e., where the plunger contacts the orifice to thereby close the valve.

In the embodiment shown, the non-contact valves are configured with respective gas porous rings. However, it is to be understood that the non-contact valves of the present invention can be alternately configured with variously-shaped gas porous elements or members, such as, for example, rectangular gas-porous members and correspondingly shaped/configured plugs.

In the embodiment shown, the non-contact valves are configured with respective gas porous ring members and gas-impermeable plug members. However, it is to be understood that the non-contact valves of the present invention can be alternately configured, such as, for example, with a gas-impervious ring and a gas-porous plug member.

In the embodiment shown, the non-contact valves are configured with plug members that are movable with respect to a corresponding ring member. However, it is to be understood that the non-contact valves of the present invention can be alternately configured, such as, for example, with ring members that are axial movable with respect to corresponding plug members.

It is to be understood that although variable-orifice non-contact valves 24 and 26 are referred to as "non-contact" variable orifice valves, the valves may be configured and/or operated as contacting valves wherein components within the valve come into actual mechanical contact in order to control material flow. Whether the valves are operated as contact or non-contact valves is dependent upon whether the material M being controlled is susceptible to the adverse affects, such as fusing, of contacting valve or other mechanical members. Thus, the use of the term "non-contact" herein, and in relation to valves 24 and 26, is not to be construed as necessarily limiting the valves to a non-contacting method of operation. The actual mode of operation (i.e., contact or non-contact) of the valves is determined in part by the properties of material M and the use to which the valves are applied.

While this invention has been described as having preferred embodiments, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

PARTS LIST

10 Apparatus
12 Pulverizer
14 Rotary Air Lock Valve
16 Reservoir Hopper
18 Transition and Pipe Assembly
20 Feeder Hopper
22 Discharge Hopper
24 Variable-Orifice Non-Contact Valve
26 Non-Contact Valve
30 Programmable Logic Controller
32 Gas Supply and Control System
34 Fill Station
36 RALC Signal
42 Gas-Permeable Liner
46 Low Level Sensor
48 High Level Sensor
52 Inner Conduit
64 Gas Inlets
70 Top
72 Gas-Permeable Liner
74 Gas Inlet
82 Gas-Permeable Liner
84 Gas Inlet
86 Filling Tube
90 Load Cell
92 LC Signal

PARTS LIST (CONTINUED)

102 Outer Body
104 Plug
106 Gas-Porous Ring
108 Flange
110 Front Plate Member
114 Gas Inlet
116 Sealing Member
118 Chamber
122 Inlet Orifice
124 Flow Path
126 Mounting Flanges
140*a* Actuator
140*b* Actuator
216 Gas Flow Valve
218 Gas Flow Valve
220 Gas Flow Valve
224 Gas Flow Valve
226 Gas Flow Valve
316 Gas Valve Control Signal
318 Gas Valve Control Signal
320 Gas Valve Control Signal
322 Gas Valve Control Signal
324 Gas Valve Control Signal
326 Gas Valve Control Signal
330 Scale
334 Weight Signal
336 Vents
370 Toner Bottle

PARTS LIST (CONTINUED)

400 Apparatus
416 Reservoir Hopper
418 Transition and Pipe Assembly
424 Non-Contact Valve
430 Programmable Logic Controller
432 Gas Supply and Control System
440 Actuator
490 Load Cells
HL Signal—High Level Signal
LL Signal—Low Level Signal
A—Central Axis
F—Direction of Material Flow
M—Particulate Material

What is claimed is:

1. An apparatus for handling bulk particulate material, comprising:

a reservoir hopper including a gas-permeable liner lining at least a portion of said reservoir hopper, at least one gas inlet configured for connecting said reservoir hopper to a pressurized flow of gas;

a transition and pipe assembly in fluid communication with and configured for receiving material from said reservoir hopper, said transition and pipe assembly having an outer conduit, an inner conduit, and at least one gas inlet, said outer conduit being substantially impervious to gas, said inner conduit being permeable to gas, said inner conduit disposed within and surrounded by said outer conduit, each said at least one gas inlet configured for connecting said outer conduit to a pressurized flow of gas; and a first variable-orifice non-contact valve configured for controlling a flow of material by a curtain of gas from said transition and pipe assembly.

2. The apparatus of claim 1, further comprising a feeder hopper in fluid communication with and configured for receiving material from said transition and pipe assembly, said feeder hopper including a gas-permeable inner liner lining at least a portion of said feeder hopper, at least one gas inlet configured for connecting said feeder hopper to a pressurized flow of gas.

3. The apparatus of claim 2, further comprising a discharge hopper in fluid communication with and configured for receiving material from said feeder hopper, said discharge hopper including a gas-permeable inner liner lining at least a portion of said discharge hopper, at least one gas inlet configured for connecting said discharge hopper to a pressurized flow of gas.

4. The apparatus of claim 3, wherein said first variable orifice non-contact valve is disposed between said transition and pipe assembly and said discharge hopper, said first variable orifice non-contact valve configured for controlling a flow of material from said transition and pipe assembly to said discharge hopper.

5. The apparatus of claim 4, wherein said first variable orifice non-contact valve is connected to an outlet end of said transition and pipe assembly, said first variable orifice non-contact valve being disposed within said feeder hopper and configured for controlling a flow of material from said transition and pipe assembly into said feeder hopper, said gas-permeable inner liner of said feeder hopper surrounding said first variable orifice non-contact valve.

6. The apparatus of claim 3, further comprising a filling tube in fluid communication with and configured for receiving material from said discharge hopper.

7. The apparatus of claim 6, further comprising a second non-contact valve disposed between and in fluid communication with each of said discharge hopper and said filling tube, said second non-contact valve configured for controlling a flow of material from said discharge hopper to said filer tube.

8. The apparatus of claim 7, further comprising a gas supply and control system configured for supplying a flow of pressurized gas to each of said gas inlets.

9. The apparatus of claim 8, wherein said gas supply and control system includes a plurality of interconnected conduits and a plurality of gas flow control valves, each of said plurality of conduits connected to a corresponding one of said gas inlets, each of said plurality of gas flow control valves operably associated with a corresponding one of said plurality of conduits.

10. The apparatus of claim 9, wherein each of said reservoir hopper, said transition and pipe assembly, said feeder hopper, and said discharge hopper include respective vents, said vents being operable to reduce a pressure of the pressurized gas within the corresponding said reservoir hopper, said transition and pipe assembly, said feeder hopper, and said discharge hopper.

11. The apparatus of claim 10, further comprising a programmable logic controller interconnected with and controlling each of said plurality of gas flow control valves and said vents.

12. The apparatus of claim 2, further comprising a filling station, said filling station configured for bringing a end-use container into a filling position wherein said end-use container receives material from said filling tube.

13. The apparatus of claim 12, further comprising a scale, said scale issuing a weight signal to said programmable logic control, said weight signal being indicative of a weight of said end-use container and thereby an amount of material therein.

14. The apparatus of claim 13, wherein said programmable logic controller issues gas valve control signals and vent control signals to said gas flow control valves and said vents, respectively, dependent at least in part upon said weight signal.

15. The apparatus of claim 14, further comprising at least one weight-sensing device associated with said discharge hopper, said weight-sensing device issuing to said programmable logic controller a weight signal indicative of a weight of material within said discharge hopper, said programmable logic controller issuing an actuator control signal to said second non-contact valve dependent at least in part upon said weight signal to thereby increase or decrease a rate of flow of said material within at least one of said reservoir hopper, said transition and pipe assembly, said second non-contact valve, and said feeder hopper.

16. An apparatus for filling end-use containers with toner, comprising:

a rotary air lock valve;

a reservoir hopper in fluid communication with and configured for receiving toner from said rotary air lock valve, said reservoir configured for fluidizing the toner therein;

a transition and pipe assembly in fluid communication with and configured for receiving toner from said reservoir hopper, said transition and pipe assembly configured for fluidizing the toner therein;

a first variable orifice non-contact valve configured for controlling a flow of fluidized toner by a curtain of gas from said transition and pipe assembly;

a discharge hopper in fluid communication with and configured for receiving toner from said transition and pipe assembly, said discharge hopper configured for fluidizing the toner therein;

a bottle filling tube in fluid communication with and configured for receiving toner from said discharge hopper; and a bottle filling station configured for bringing a toner bottle into fluid communication with said filling tube.

17. The apparatus of claim 16, wherein said reservoir hopper includes at least one gas inlet and an inner gas-permeable liner, said at least one gas inlet configured for connecting said reservoir hopper to a supply of pressurized gas.

18. The apparatus of claim 16, wherein said transition and pipe assembly includes at least one gas inlet, an outer gas-impervious conduit and an inner gas-permeable conduit, said at least one gas inlet configured for connecting said transition and pipe assembly to a supply of pressurized gas.

19. The apparatus of claim 16, wherein said discharge hopper includes at least one gas inlet and an inner gas-permeable liner, said at least one gas inlet configured for connecting said discharge hopper to a supply of pressurized gas.

20. The apparatus of claim 16, further comprising a gas supply and control system including a plurality of interconnected conduits and a plurality of gas flow control valves, each of said plurality of conduits connected to a corresponding one of said reservoir hopper, said transition and pipe assembly, and said discharge hopper, each of said plurality of gas flow control valves operably associated with a corresponding one of said plurality of conduits.

21. The apparatus of claim 20, further comprising at least one respective vent associated with each of said reservoir hopper, said transition and pipe assembly, and said discharge hopper, said vents being operable to reduce a pressure of the pressurized gas within the corresponding said reservoir hopper, said transition and pipe assembly, and said discharge hopper.

22. The apparatus of claim 21, further comprising a programmable logic controller interconnected with said bottle filling station and receiving therefrom a weight signal, said programmable logic controller controlling each of said plurality of gas flow control valves and said vents dependent at least in part upon said weight signal.

23. A feeder for fine powder material, comprising:

a reservoir hopper including a gas-permeable liner lining at least a portion of said reservoir hopper, at least one gas inlet configured for connecting said reservoir hopper to a pressurized flow of gas;

a transition and pipe assembly in fluid communication with and configured for receiving material from said reservoir hopper, said transition and pipe assembly having an outer conduit, an inner conduit, and at least one gas inlet, said outer conduit being substantially impervious to gas, said inner conduit being permeable to gas, said inner conduit disposed within and surrounded by said outer conduit, each said at least one gas inlet configured for connecting said outer conduit to a pressurized flow of gas; and a variable-orifice non-contact valve associated with an end of said transition and pipe assembly that is opposite to said reservoir hopper, said valve being configured for controlling a flow of material by a curtain of gas from said transition and pipe assembly, said valve having a gas inlet configured for being connected to a pressurized flow of gas.

24. The feeder of claim 23, further comprising at least one load cell associated with said reservoir hopper and being configured for sensing and indicating one of a loss in weight of said reservoir hopper.

* * * * *